US005228386A

United States Patent [19]

Suematsu et al.

[11] Patent Number: 5,228,386

[45] Date of Patent: Jul. 20, 1993

[54] PRINT HAMMER ASSEMBLY FOR DOT LINE PRINTER

[75] Inventors: Shigenori Suematsu; Yoshikane Matsumoto; Hirotaka Kobayashi; Kenichi Kugai; Shinichi Sakamoto, all of Katsuta, Japan

[73] Assignee: Hitachi Koki Co., Ltd., Tokyo, Japan

[21] Appl. No.: 873,829

[22] Filed: Apr. 27, 1992

[30] Foreign Application Priority Data

Apr. 26, 1991 [JP] Japan ..... 3-97389

[51] Int. Cl.[5] ..... B41J 3/00

[52] U.S. Cl. ..... 101/93.04; 101/93.05; 400/124; 400/157.2

[58] Field of Search ..... 101/93.04, 93.05, 93.29; 400/124, 121, 157.1, 157.2

[56] References Cited

U.S. PATENT DOCUMENTS

| | | | |
|---|---|---|---|
| 4,386,563 | 6/1983 | Farb | 101/93.04 |
| 4,553,864 | 11/1985 | Hayashi | 101/93.04 X |
| 4,879,947 | 11/1989 | Kurosawa et al. | 101/93.04 |
| 4,936,210 | 6/1990 | Ukai | 101/93.04 |
| 5,118,210 | 6/1992 | Kobayashi et al. | 400/124 |

FOREIGN PATENT DOCUMENTS

| | | | |
|---|---|---|---|
| 0051460 | 3/1987 | Japan | 101/93.29 |
| 0064861 | 3/1989 | Japan | 101/93.04 |
| 0009853 | 1/1991 | Japan | 101/93.29 |

OTHER PUBLICATIONS

IBM Technical Disclosure Bulletin, vol. 27, No. 2, Jul. 1984 "Print Hammer Mounting Arrangement For A Matrix Printer".

*Primary Examiner*—Edgar S. Burr
*Assistant Examiner*—Christopher A. Bennett
*Attorney, Agent, or Firm*—Sughrue, Mion, Zinn, Macpeak & Seas

[57] ABSTRACT

In a print hammer assembly for a dot line printer, print pins are attached to the tip ends of print hammers alternately displaced toward left and right by a predetermined distance from a vertical center of the print hammer, wherein comb portions of a front yoke at both sides of the plunger are made to be an equal width. With such an arrangement, the print pins are not deformed horizontally due to imbalanced magnetic force applied to the associated print hammer at the time of magnetization of a permanent magnet.

6 Claims, 5 Drawing Sheets

PRINT HAMMER ASSEMBLY FOR DOT LINE PRINTER

BACKGROUND OF THE INVENTION

1. Field of the Invention

The invention relates generally to a dot line printer, and more particularly to an improved print hammer assembly for a dot line printer. The dot line printer has a hammer bank accommodating a plurality of hammers juxtaposed along a print line extending in a direction perpendicular to a direction in which a print paper is fed, wherein printing is carried out during reciprocal movements of the hammer bank along the print line.

2. Description of the Related Art

In a dot line printer, a plurality of print hammers which are magnetically attracted to non-printing positions are selectively fired for making dot impressions on a print paper when a driving current of a predetermined duration is applied to a magnetic coil provided in association with the print hammer. In such a printer, it is a general practice to selectively displace the print hammer positions by a half-dot or a quarter-dot distance form equi-distant positions in order to reduce the number of simultaneously fired print hammers and to decrease the driving current. The half dot distance is defined by a half of a reciprocal of a number of printable dots per unit length, typically expressed by a unit of dots per inch (dpi). Similarly, the quarter dot distance is defined by a quarter of a reciprocal of a number of printable dots per unit length.

FIGS. 1 and 2 show a half-dot displaced hammer arrangement wherein the print pins 42 are alternately displaced a half-dot distance a( a being about 0.07 mm in the illustrated example) from the equi-distance position spaced apart an equi-distance $P_1$ from the adjacent print pin 42 ($P_1$ being about 3.8 m in the illustrated example). With such a displaced arrangement, while the number of simultaneously fired print pins are reduced by one half as compared with an equi-distance hammer arrangement, the plungers 432 of the displaced print hammers are also displaced the same distance.

On the other hand, it has been contemplated to tightly arrange an increased number of print hammers in order to speed up printing. However, if the hammer-to-hammer pitch $P_1$ is reduced to this end, sufficient magnetic attraction is not obtainable due to the reduction of magnetic flux flowing into the plunger. To obviate such a problem, it has been proposed to configure the plunger into a rectangular shape so as to correspond to the configuration of the plunger receiving surface at the comb yoke and to change the circular hole formed in the front yoke to a rectangular groove.

FIG. 3 shows an example of a print hammer assembly having rectangular plungers. As the print hammers are formed in an increased density, the width of the print hammer is smaller than that of the conventional print hammer. In the example shown in FIG. 3, the hammer-to-hammer pitch $P_2$ is set to about 2.5 mm. Due to the lean print hammer, the horizontal rigidity is lessened and thus the print hammer is liable to be horizontally deformed if force to this effect is applied to the print hammer. Furthermore, since the print pins 52 are alternately displaced a half-dot distance a (a being about 0.07 mm), the associated plunger positions are also displaced the same distance. As a result, the widths of the comb portions of the front yoke 55 are unequal at leftside and rightside of the plunger 53.

To assemble these components, a permanent magnet is magnetized after fixedly securing the leaf spring 51 formed with the print hammers at given pitch. At this time, the magnetic flux flowing into left and right side comb portions of the front yoke 55 through the plunger 53 are unequal. The print pin 52 tends to be inclined toward the wider width comb portion of the front yoke 55, resulting in a horizontal displacement of the print pin 52. If the print hammer is fired in such a condition, the dot impression made on the print sheet is also displaced from the regular position, thus the print quality is degraded.

SUMMARY OF THE INVENTION

Accordingly, it is an object of the present invention to provide a print hammer assembly free from print pin inclination at the time of assembling to thereby attain an excellent print quality.

To achieve the above and other objects, there is provided a print hammer assembly for a dot line printer, which includes a leaf spring formed with a plurality of print hammers, each print hammer having a tip end and being movable between a first position and a second position. A plurality of plungers are provided respectively to the plurality of print hammers, and a plurality of print pins are provided respectively to the tip ends of the plurality of print hammers for making dot impressions on a print paper, wherein the plurality of print pins are arranged on a print line in a predetermined unequal interval relation. There are provided magnetic means for magnetically attracting the plurality of print hammers in the first position and a plurality of electromagnetic coils in association with the plurality of print hammers for releasing the print hammer from the first position and allowing to move toward the second position when a corresponding electromagnetic coil is energized. A front yoke is disposed in facial contact with the leaf spring. The plurality of plungers are arranged at equi-distance along a line which is parallel to the print line. The plurality of plungers have equal widths in the direction of the line.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
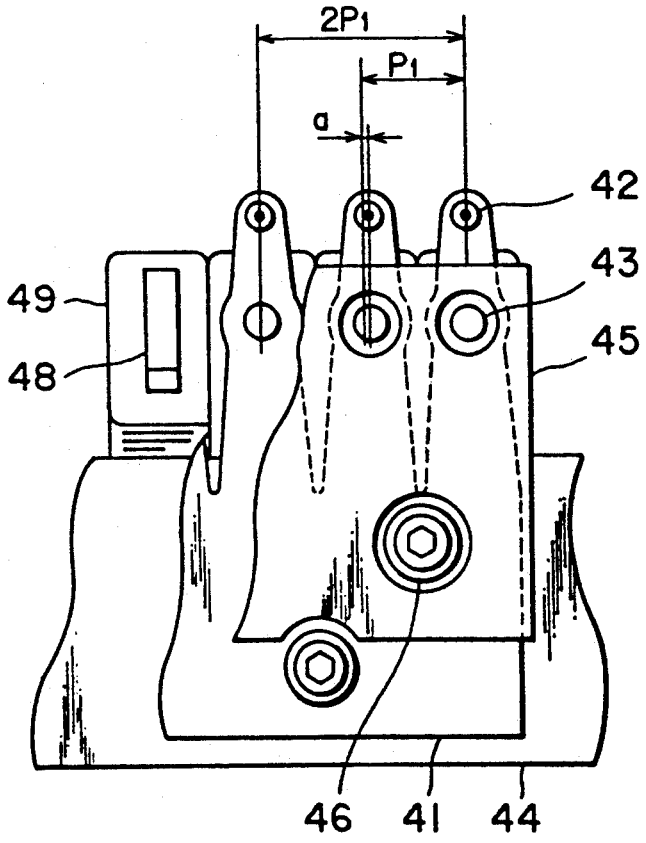
FIG. 1 PRIOR ART
FIG. 1 is a front view partially showing a print hammer assembly for a conventional dot line printer.
Figure 2:
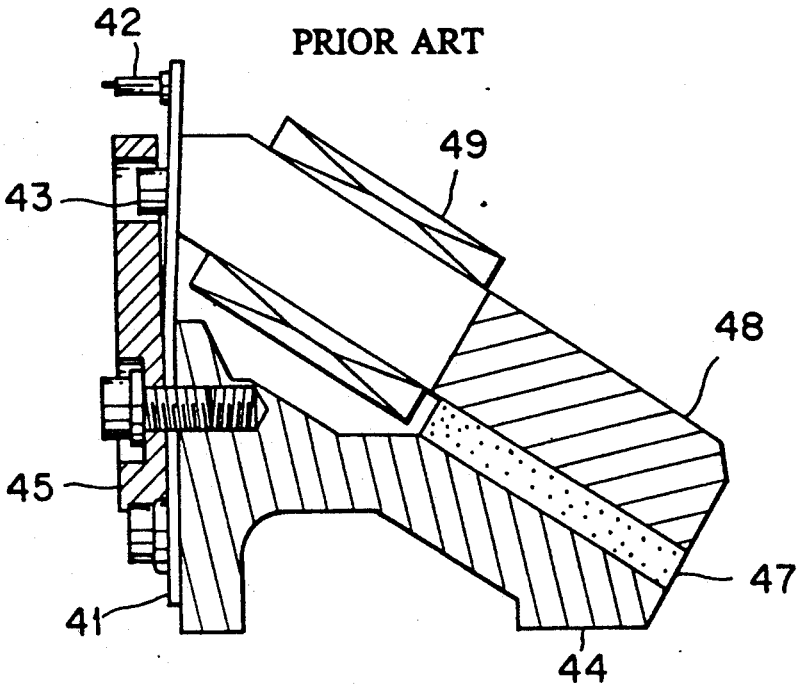
FIG. 2 PRIOR ART
FIG. 2 is a side cross-sectional view showing the print hammer assembly shown in FIG. 1.
Figure 3:
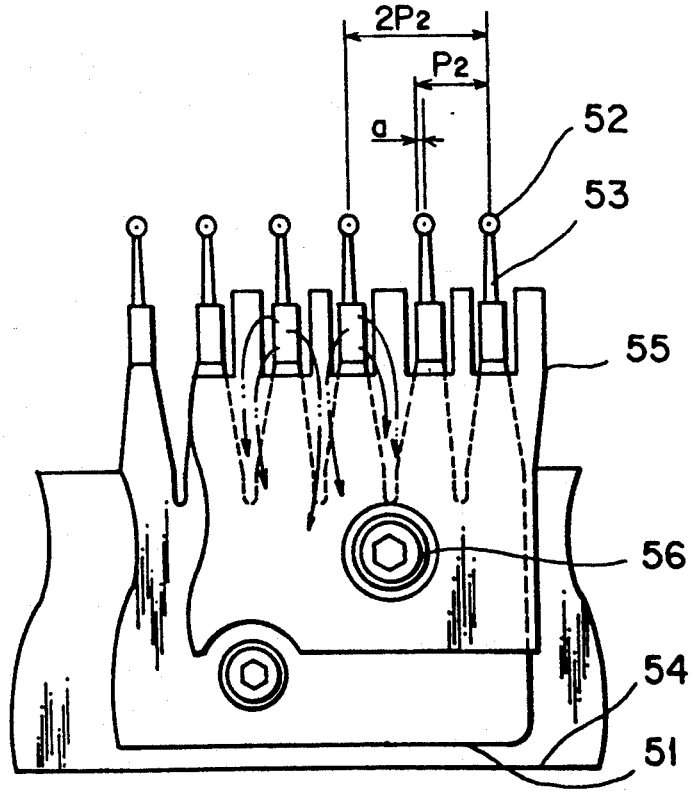
FIG. 3 is a front view partially showing a print hammer assembly using a rectangular plunger.
Figure 4:
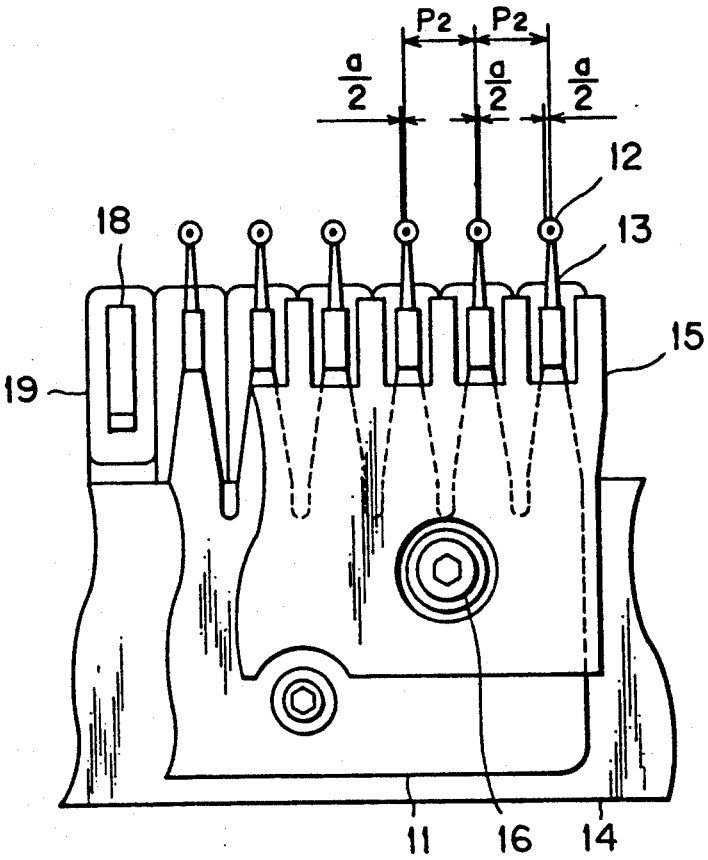
FIG. 4 is a front view partially showing a print hammer assembly according to a first embodiment of the present invention.
Figure 5:
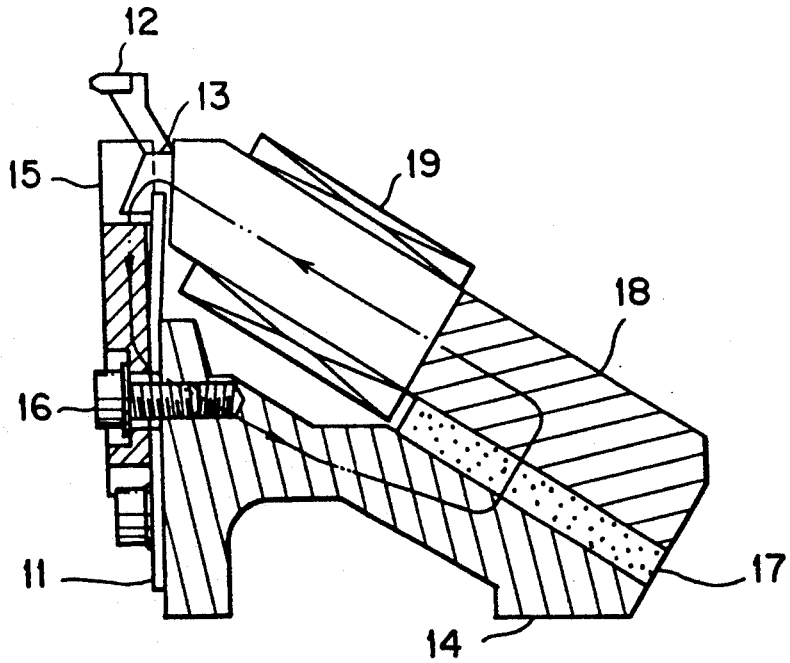
FIG. 5 is a side cross-sectional view showing the print hammer assembly shown in FIG. 4.

As shown in FIGS. 4 and 5, a leaf spring 11 is formed with a plurality of print hammers at its upper portion. A common base portion of the leaf spring 11 and a front yoke 15 are fixedly secured to the front face of a base 14 by virtue of screws 16. Each print hammer has a print pin 12 attached to its tip end and a plunger 13 brazed at its upper portion. The plunger 13 is held against the pole of a comb yoke 18 by magnetic attraction of a permanent magnet 17. An electromagnetic coil 19 is wound around the pole of the comb yoke 18.

The plungers 13 are horizontally arranged so as to be equidistance, and the widths of comb portions of the front yoke 15 are made equal to one another. Every other print pin is leftwardly displaced a distance a/2 from the vertical center of the print hammer and the remaining print pins are rightwardly displaced the same distance from the vertical center of the print hammer so as to maintain a half-dot distance displacement relation.

With such an arrangement, the magnetic flux uniformly flows into left and right comb portions of the front yoke 15 through the plunger 13. Therefore, the forces imparted on the plunger 13 are balanced and thus the print pin 12 is not inclined when the magnet 17 is magnetized. The print pin positions set prior to magnetization can be maintained as they stand.

Figure 6:
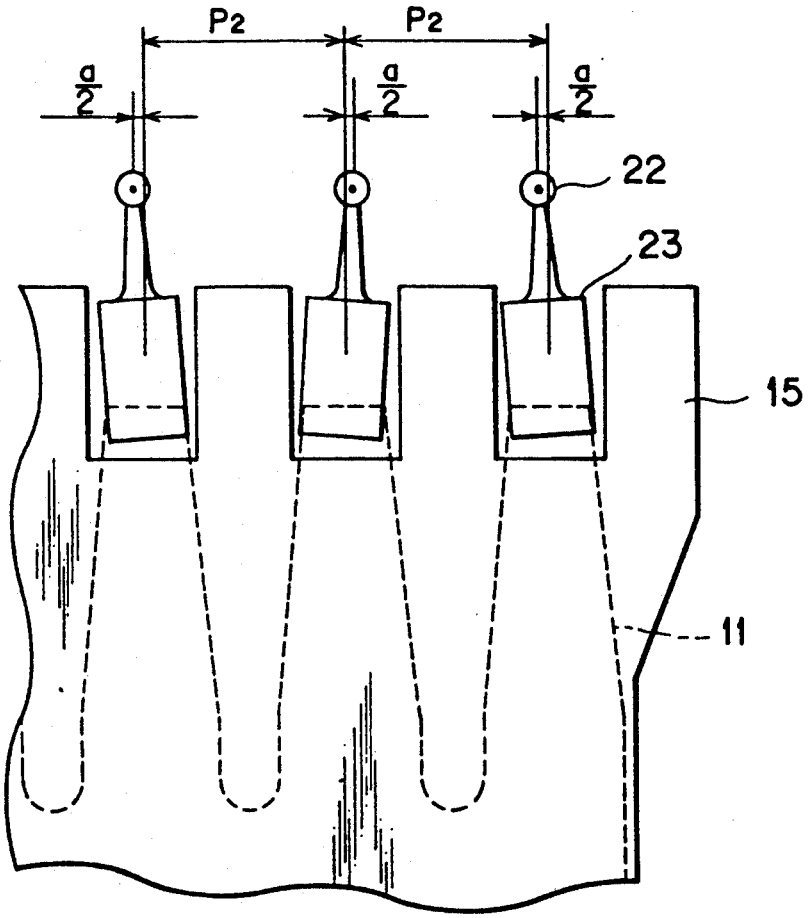
FIG. 6 is a front view partially showing a print hammer assembly according to a second embodiment of the present invention.

FIG. 6 shows the print hammer assembly according to a second embodiment of the present invention. In this embodiment, the print pin 22 and the plunger 23 are integrally formed. The plungers 23 are secured to the respective top portions of the print hammers in an inclined manner. Specifically, every other plunger is leftwardly inclined whereas the remaining plungers are rightwardly inclined so that the center-to-center distance of the plungers 23 are spaced apart an equi-distance from one another and the half-dot distance displaced relation of the print pins are maintained. With such an arrangement, there is no substantial inclination of the print pins 22 at the time of magnetization of the magnet.

Figure 7:
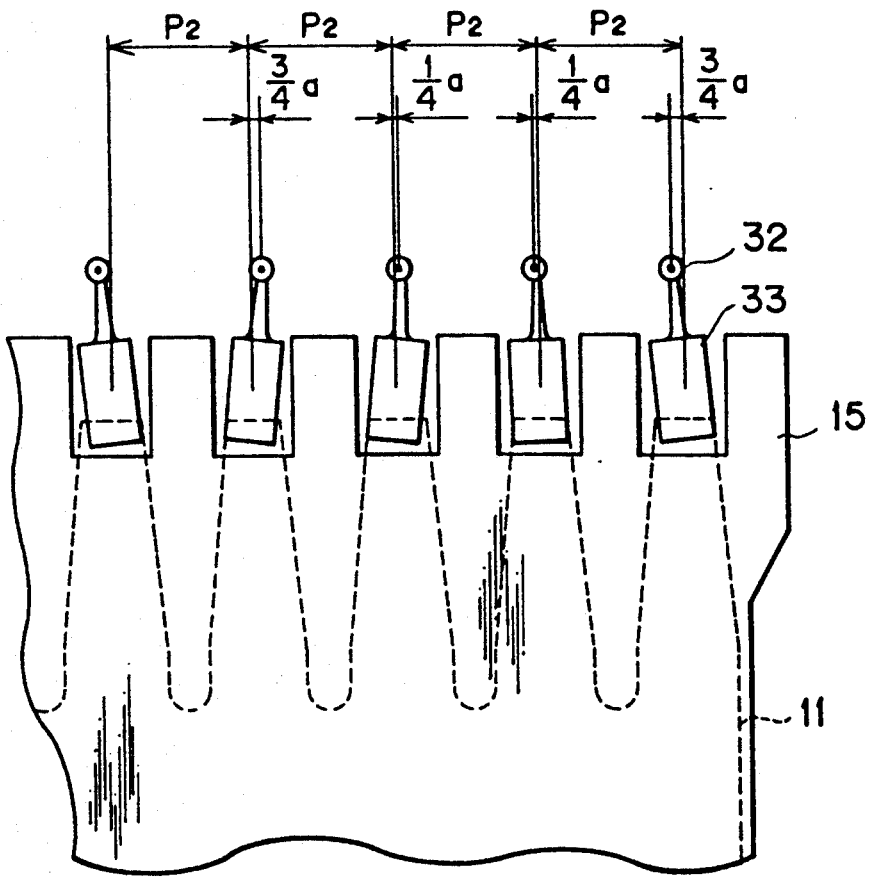
FIG. 7 is a front view partially showing a print hammer assembly according to a third embodiment of the present invention.

FIG. 7 shows a print hammer assembly according to a third embodiment of the present invention. The third embodiment is similar to the second embodiment but differs therefrom in that the plungers 33 are secured so that the print pins are arranged in a quarter-dot distance displaced relation.

According to the present invention, since the print pin positions are not shifted after magnetization of a permanent magnet, the print hammer assembly can easily be fabricated. Further, the print pin positions can be maintained with high accuracy, whereby a high speed dot line printer affording a high printing quality can be provided. With the use of integral structure of the print pin and the plunger, the fabrication of the print hammer assembly can be facilitated and thus an inexpensive dot line printer can be provided.

What is claimed is:

1. A print hammer assembly for a dot line printer, comprising:

a leaf spring having a plurality of print hammers formed thereon, each print hammer having a tip end which is movable between a first position and a second position;

a plunger provided respectively on each of said plurality of print hammers;

a plurality of print pins provided respectively on the tip ends of said plurality of print hammers for making dot impressions on a print paper, said plurality of print pins being arranged on a print line in a predetermined unequal interval relation;

magnetic means for magnetically attracting said plurality of print hammers into said first position;

an electromagnetic coil provided in association with each of said plurality of print hammers for releasing said print hammers from said first position and allowing said print hammers to move toward said second position when a corresponding one or said electromagnetic coils is energized; and a front yoke disposed in facial contact with said leaf spring;

said plurality of plungers being arranged so that centers of adjacent plungers are at equal distances from each other along a line parallel to the print line, said plurality of plungers having equal widths in the direction of said line.

2. A print hammer assembly according to claim 1, wherein every other one of said print pins is displaced leftwardly a predetermined distance a2 from a vertical centerline of a corresponding one of said plungers and the remainder of said print pins are displaced rightwardly the predetermined distance a/2 form the vertical centerline of a corresponding one of said plungers.

3. A print hammer assembly according to claim 2, wherein the distance a is equal to a one half of a reciprocal of printable dots per unit length.

4. A print hammer assembly according to claim 1, wherein said print pins and said plungers are integrally formed, each of said plungers being secured to a respective one of said print hammers in an inclined manner with respect to a vertical centerline of a corresponding one of said print hammers.

5. A print hammer assembly according to claim 4, wherein said plungers are of a rectangular shape.

6. A print hammer assembly according to claim 1, wherein said print hammers are parallel to each other and said print pins are offset from a vertical centerline of a respective one of said print hammers.

* * * * *